United States Patent [19]

Cyrenne

[11] 4,115,189

[45] Sep. 19, 1978

[54] PAPER MACHINE DRAW ROLL

[76] Inventor: Roland O. Cyrenne, 1570 Lachance St., Sherbrooke, Quebec, Canada, J1J 1B3

[21] Appl. No.: 769,351

[22] Filed: Feb. 16, 1977

[30] Foreign Application Priority Data

Feb. 20, 1976 [CA] Canada ..... 246216

[51] Int. Cl.[2] ..... D21F 1/40; D21F 2/00

[52] U.S. Cl. ..... 162/305; 162/306

[58] Field of Search ..... 162/305, 306, 307, 358

[56] References Cited

U.S. PATENT DOCUMENTS

| | | | |
|---|---|---|---|
| 2,888,074 | 5/1959 | Hornbostel | 162/306 |
| 3,598,697 | 8/1971 | McKie et al. | 162/306 |
| 3,826,713 | 7/1974 | Nykopp | 162/358 X |

*Primary Examiner*—Richard V. Fisher
*Attorney, Agent, or Firm*—H. Wayne Rock

[57] ABSTRACT

The present invention relates to an improvement in the feeding of a wet web of paper from the fourdrinier wire of a paper making machine, at the couch roll thereof, to the felt of the adjacent first press section. A corner roll of the press section, with the felt entrained therearound is adjacent the couch roll, and a draw roll is positioned above the corner roll and slightly downstream thereof relative to the couch roll. The draw roll is in contact with the wet web on the felt and is driven thereby. This configuration results in fewer breaks and a cleaner web, thereby increasing productivity and reducing downtime.

2 Claims, 3 Drawing Figures

PAPER MACHINE DRAW ROLL

This invention relates to paper making machines, particularly those of the fourdrinier type which have an open draw between the couch and the first press. At the open draw the newly formed wet web of fibers that is on the fourdrinier wire has to jump unsupported between the couch and the first press.

BACKGROUND OF THE INVENTION

This area of open draw has always been a source of problems in paper machine operation. The wet web of fibers is very weak at this point, and any imperfection or weakness in the wet web may cause the wet web to break. There has been a great deal of research and development done to overcome this problem and probably the most outstanding development is the pickup press. The pickup press actually comes into contact with the fourdrinier wire at the couch roll and by a slight vacuum attaches the wet web to the press felt so that it does not have to jump across to the press. The improvement offered by the pickup press is, however, not without cost as large and expensive equipment is required. As a result many of the older fourdrinier paper machines continue to operate as previously, with an open draw. Either they do not have the space for this additional equipment or it is considered too expensive.

It has also been common practice to locate a draw roll in between the couch and the first press, the purpose of which is to hold the wet web of paper down to maintain the proper angle of takeoff of the wet web at the couch roll as it leaves the fourdrinier wire.

However, in so accomplishing this necessary task the draw roll has given birth to other problems, many of which are serious in their own right. Some of these problems will be delineated in the following paragraphs.

Every time the wet web breaks, the draw roll has to be raised in order to pass the lead strip thereunder and then it must be repositioned. This physical act of bringing the draw roll back into position against the wet web can be a cause of trouble as the sheet is weak and delicate at this point and can easily break. It takes an experienced operator to pass the lead strip and make the necessary adjustments before normal paper manufacture can be resumed.

It is common for draw rolls to pick up deposits from the top of the wet web. These deposits are only lightly attached to the draw roll and frequently break off and cause holes, lumps and other imperfections in the wet web travelling underneath. Cleaning the draw roll while the wet web is running is difficult and may in fact be impossible. Furthermore the surface damage to the sheet cannot be repaired and it will thus be of inferior quality.

The diameter of the prior art draw roll must necessarily be small because of the very limited space available. This causes a deflection problem, with the draw roll sagging in the middle and depressing the wet web more in the center. Depending upon the grade of paper being run and the equipment available this gives rise to a whole series of other potential problems, such as paper which is baggy in the center, flapping and flutter in the dryers, uneven tension, wrinkles, edge cracks, pull apart, sheet drooping on the sides, air entrainment, etc. These are some of the disadvantages caused by draw rolls.

SUMMARY OF THE INVENTION

The invention I have conceived to reduce the number of these problems relates to the geometry of the path of the wet web and can be accomplished by relocating the draw roll and the first corner roll of the press. The first corner roll is the felt roll closest to the couch roll on an open draw. In my invention the draw roll is now located directly on the press felt and is driven by it at the same speed as the press. The corner roll of the press has been adjusted so that the draw roll in this new position can be aligned to provide a satisfactory angle of take off of the wet web from the couch roll.

Furthermore, the draw roll may be grooved to provide less surface in contact with the wet web. These changes have contributed significant improvements. The draw roll stays cleaner as there are fewer deposits thereon and fewer lumps breaking loose therefrom. There are no more problems associated with deflection of the draw roll. Larger, stronger and better rolls of new composition can be used as draw rolls in the new position. It is easier to pass the lead strip successfully with less adjustment and this saves manufacturing time. These improvements were welcome and have completely justified my work. Paper machines utilizing my invention are operating with less trouble and less down time as a result of the above mentioned improvement in the geometry of the draw roll and the corner roll of the press. Also there are fewer defects in the paper being made.

These changes have also produced unexpected rewards which to a considerable extent are superior to the improvements already sought after. First of all the wet web is now stronger than previously. We found there was less draw or speed differential required between the couch and the first press in order to maintain a straight take off line and to keep the sheet at the preferred take off angle. This decrease in draw was entirely unexpected. This has resulted in less internal strain in the fiber configuration of the wet web with the result that the sheet is not only stronger across the first open draw, but the paper machine is running with fewer breaks because of this increase in strenght. The efficiency of the paper machine has increased as a result.

Briefly therefore the present invention provides in a paper machine having a wet web forming section including a fourdrinier wire entrained about a couch roll and a press section including a continuous felt entrained about a corner roll adjacent the couch roll, the improvement in feeding a wet web of paper from the wire to the felt comprising a draw roll positioned above the corner roll slightly downstream of the corner roll relative to the couch roll, the draw roll being adapted to contact the wet web on the felt.

DETAILED DESCRIPTION OF THE DRAWINGS

Figure 1:
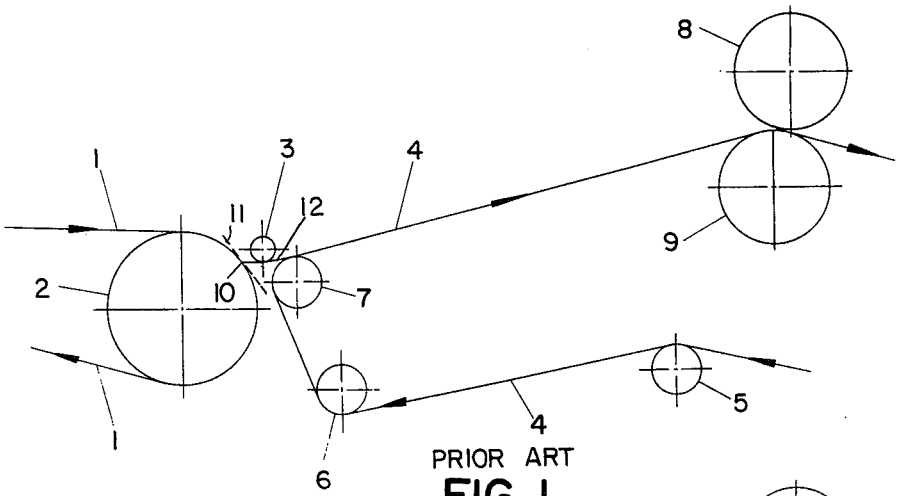
PRIOR ART FIG. 1
FIG. 1 shows a schematic outline of the open draw area between the fourdrinier and the first press, the drawing showing a prior art configuration.

FIG. 1 shows a schematic representation of the area of a fourdrinier paper machine referred to as the couch and the first press, which I am sure will be apparent to one familiar with the art.

The fourdrinier wire 1. is carrying a wet web of fibers to the suction couch roll 2. The wire continues to follow the couch roll around its periphery from top to bottom and returns on the underside of the couch roll as a continuous belt to the breast roll.

At point 10 on the couch roll the wet web of fibers separates from the fourdrinier wire 1. and travels in an approximately horizontal direction under the draw roll 3 and on to the felt 4 which is turning by the first corner roll 7 and is in a position to receive the wet web on top of it and carry it into the nip of the first press rolls 8 and 9, and from there into the subsequent parts of the paper machine.

The felt 4 returns from its continuous journey and turns around felt rolls 5 and 6 and back around felt roll 7 where it continuously receives the wet web of fibers jumping unsupported across the distance from the point 10 on the couch roll under the draw roll 3 to land on top of the press felt 4.

FIG. 1 also shows the imaginary line 11 which is the tangent to the periphery of the couch roll 2 at point 10 where the wet web of fibers 12 leaves the couch roll to go under the draw roll 3. The angle between this imaginary tangent 11 and the approximately horizontal line of travel of the wet web of fibers 12 is called the "take off" angle of the wet web. This is found in practice to be an important angle from the point of view of separating the wet web of fibers from the mesh of the fourdrinier wire 1. This angle may vary depending upon the speed of the paper machine and the grade of paper being manufactured and other factors. However, for the machine in question an optimum angle for maximum performance has been found by experience and there are minimum and maximum variations which are permissible.

Figure 2:
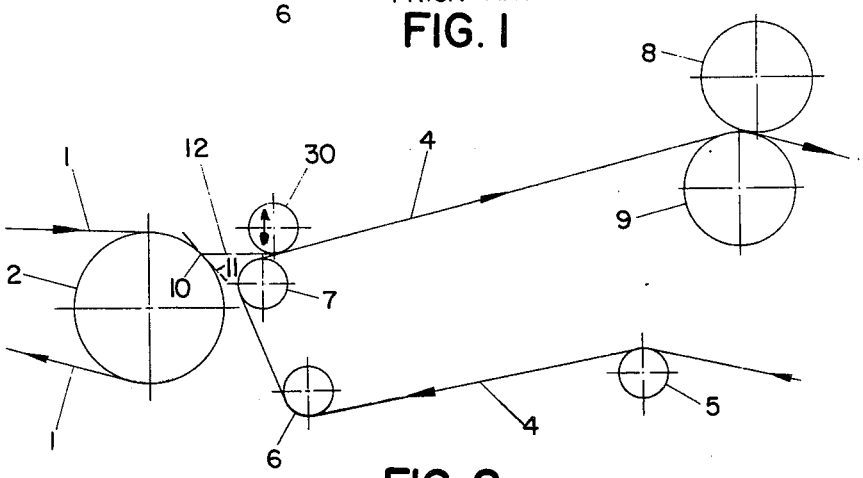
FIG. 2 show a schematic outline of the open draw area of FIG. 1 but utilizing the present invention.

In FIG. 2 I have shown a section of the same paper machine modified according to my studies in order to produce the improvement conceived in my invention. In FIG. 2 a fourdrinier wire 1 is carrying a wet web of fibers to the suction couch roll 2. The wire continues to follow the couch roll around its periphery from top to bottom and returns on the underside of the couch roll as a continuous belt to the breast roll.

At point 10 the wet web of fibers 12 separates from the wire and travels in an approximately horizontal direction at a satisfactory angle from the tangent 11 which forms at point 10 on the couch.

An endless felt 4 travels around felt roll 5 and then under felt roll 6 and around the first corner roll 7, where the felt comes into contact with the wet web of fibers 12 which at that point is entering into rotating contact with draw roll 30. The draw roll 30 and the first corner roll 7 are in close proximity to one another but are not forming a pressure nip between them. The draw roll is positioned above the corner roll and slightly downstream thereof relative to the couch roll. However, the felt is in contact with the wet web of fiber and the wet web of fiber is in contact with the draw roll 30, and this provides a driving force for rotating draw roll 30.

The wet web of fibers continues along press felt 4 into the nip between the granite roll 8 which is the top roll of the press and the press roll 9. After going through this press the wet web of fibers continues along through the rest of the paper machine.

Figure 3:
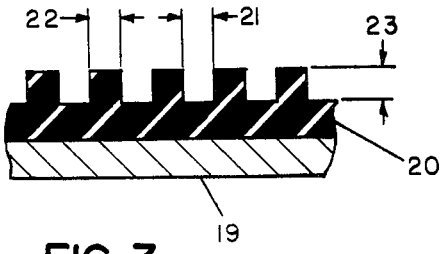
FIG. 3 shows an axial section through the cylindrical wall of the draw roll utilized in the present invention.

FIG. 3 is a cross section showing the grooved surface of the draw roll 30. An exterior cylinder of rubber 20 has been shrunk over the cylindrical roll 19, and individual circumferential grooves have been cut in the roll in the direction of rotation, the grooves being axially spaced.

In table 1 various dimensions which have been found satisfactory for this paper machine are shown for the distance 21 between the grooves, the horizontal width of the protruding rings 22, the depth of the groove 23 as well as for the positioning of the draw roll.

TABLE 1

| | Optimum | Minimum | Maximum |
|---|---|---|---|
| Take off angle | 46° | 36° | 56° |
| Distance between Point 10 and center line of new draw roll | 16" | 10" | 40" |
| Depth of grooves point 23 | 1/8 " | 1/16" | 3/8 " |
| Width of grooves point 21 | 1/8 " | 1/16" | 3/8 " |
| Width of rings point 22 | 3/16" | 3/32" | 3/8 " |

In table 2 I have provided statistics for the paper machine in question showing the monthly lost manufacturing time for each of the six months preceding the installation of the new draw roll and for each of the six months following the installation of the new draw roll.

Table 2 shows the very considerable reduction that occurred in lost manufacturing time. The lost time for breaks at the couch was reduced by 19% and the total lost time during operation was reduced by 29%. This is an indication that the reduced internal strain on the wet web resulted in a general strength improvement and diminished the causes of lost time for breaks in the other sections of the paper machine as well. This was a benefit which was completely unexpected. The percent improvement in productivity of this paper machine as a result of this reduction in lost time in operations has averaged 1.4% since the new draw roll has been installed.

However, it took us 2 months to realize that it was now possible to run the paper machine at a faster speed than previously because the sheet is stronger. This was unexpected. Previously whenever an attempt was made to increase speed a considerable increase in breaks at the couch occurred which lowered the machine efficiency and made the operation an unsuccessful one. This improvement is shown by the statistics for the following 4 months which were run at a speed roughly 40 feet per minute faster than previously. This speed increase is of the order of 2–3% additional paper tonnage per day. So that all in all there has been a very considerable improvement as a result of this improved draw roll; more efficient machine operation; better paper quality; more speed; and a sizable increase in productivity, a total of around 4% overall.

TABLE 2

PAPER MACHINE OPERATION
MACHINE RUNNING WITH PRIOR ART DRAW ROLL

| | Lost Time Minutes per Month | | | |
|---|---|---|---|---|
| | Couch Breaks | Operation | | Speed F.P.M. |
| August | 789 | 2327 | | 1679 |
| September | 738 | 1405 | | 1688 |
| October | 828 | 1858 | | 1680 |
| November | 702 | 1909 | | 1680 |
| December | 856 | 2443 | | 1683 |
| January | 810 | 2411 | | 1689 |
| | 4723 | 12353 | Ave: | 1683 |
| **MACHINE RUNNING WITH NEW DRAW ROLL** | | | | |
| February | 770 | 1467 | | 1688 |
| March | 719 | 1575 | | 1686 |
| April | 351 | 1088 | | 1714 |
| May | 593 | 1720 | | 1738 |
| June | 725 | 1526 | | 1741 |

Note increase in machine

TABLE 2-continued

| July | 657 / 3815 | 1344 / 8720 | Ave: | 1743 / 1718 | speed from April to July |
|---|---|---|---|---|---|
| % improvement in lost time | 19% | 29% | | | |
| % improvement in productivity | | 1.4% | | 2.1% | |
| Total gain in productivity | | | | 3.5% | |

In summary therefore the present invention affords the specific advantages enumerated above, but with a minimum of expenditure. It is recognized that skilled practitioners may alter the specific configuration of the rolls somewhat without departing from the spirit of the invention and hence the invention is not to be considered as restricted to the single embodiment described herein. Improvements in the basic concept are possible for example, the draw roll may be made vertically adjustable so as to accommodate different web thicknesses or for repair purposes. The scope of protection sought should only be determined from the claims which follow.

I claim:

1. In a paper machine having a wet web forming section including a fourdrinier wire entrained about a couch roll, a press section including a continuous felt entrained about a corner roll adjacent said couch roll, the improvement in means for feeding an unsupported wet web of paper from said wire to said felt comprising a draw roll positioned above said corner roll slightly downstream of said corner roll relative to said couch roll, said draw roll having a plurality of axially spaced circumferential grooves in the outer surface thereof, said draw roll being adapted to contact said wet web on said felt.

2. The paper machine of claim 1 and including means for adjusting said draw roll vertically relative to said corner roll.

* * * * *